United States Patent [19]

Le Mer

[11] 4,302,180

[45] Nov. 24, 1981

[54] FUEL BURNER

[76] Inventor: Joseph Le Mer, Cité bellevue, St. Thegonnec, France, 29223

[21] Appl. No.: 36,453

[22] Filed: May 7, 1979

[30] Foreign Application Priority Data

Jun. 26, 1978 [FR] France ..... 78 18998

[51] Int. Cl.[3] ..... F23N 11/44

[52] U.S. Cl. ..... 431/218; 431/11; 431/208

[58] Field of Search ..... 431/11, 218, 208

[56] References Cited

U.S. PATENT DOCUMENTS

| | | | |
|---|---|---|---|
| 1,464,995 | 8/1923 | Miller | 431/218 |
| 1,668,773 | 5/1928 | La Branch . | |
| 2,162,432 | 6/1939 | Hollhous | 431/11 |
| 2,647,567 | 8/1953 | Ciglia | 431/11 |
| 3,495,576 | 2/1970 | Gysi | 431/11 |
| 4,008,041 | 2/1977 | Roffe | 431/11 |
| 4,013,396 | 3/1977 | Tenney | 431/11 |

FOREIGN PATENT DOCUMENTS

| | | |
|---|---|---|
| 428711 | 5/1928 | Fed. Rep. of Germany . |
| 530058 | 11/1921 | France . |
| 1388449 | 12/1964 | France . |
| 517913 | 2/1972 | Switzerland . |

*Primary Examiner*—George E. Lowrance
*Attorney, Agent, or Firm*—Sandler & Greenblum

[57] ABSTRACT

The burner is provided with a hollow vaporizing body, with a combustion initiating means, with heating means for starting up and with means for applying a method of burning, comprising the distinct and successive three phases:

(a) vaporization of the liquid fuel protected from the flame, (b) mixing of the vaporized fuel obtained in phase (a), with a combustion supporter such as air, in a special chamber, protected from the flame, (c) combustion of the mixture obtained from phase (b), in a suitable zone, separate from the vaporizing and mixing zones.

13 Claims, 5 Drawing Figures

FUEL BURNER

BACKGROUND OF THE INVENTION

1. Field of the Invention

The invention relates to a method of combustion for a liquid fuel and also to a burner for the application of said method. It relates more particularly to a self-cleaning complete combustion burner head.

2. Description of the Prior Art

According to a well-known burner principle, liquid fuel is atomized by means of a sprayer, then mixed with air in a combustion head, before burning it in a yellowish flame. A system based on this technique necessitates, for good combustion, the production of the flame in a sufficiently voluminous space, so that all the atomized fuel particles have time to be consumed. In fact, if the hearth wherein this form of combustion occurs is too small, the unconsumed liquid particles are projected on to the walls which, at too low a temperature, cause condensations and a certain pollution (soot, tar, etc.). It results therefrom that the combustion yield as well as the coefficient of thermal exchange of the exchanger decrease through the insulation occasioned by the soot film which is interposed between the flame and the wall of the hearth. Moreover, the minimum flow rate of the sprayers is limited.

It is an object of the invention to reduce the volume of combustion gases thus enabling reduction of the dimensions of the exchanger of heating equipment, and in particular of the hearth. In fact, combustion in the presence of a blue flame, at very high temperature, as is caused by the apparatus described in the present invention, enables a reduction of the combustion chamber by at least 90%, and consequently reduction of weight and hence of cost price of equipment to a great extent.

Reduction in the volume of exchangers enables decrease in the normal dimensions of domestic or industrial boilers, which results in considerable financial gain, the heating equipment or the location in which the equipment is situated being of reduced size.

According to another known burner principle, the liquid fuel is gasified, for example in a pot, and then burnt, mixed with air, in the form of yellow flame, sometimes blue, according to the method adopted. This form of combustion has the drawback of being difficult to control, according to the draft of the chimney, and generally necessitates an excess of air, which reduces the yield.

In another known principle of burner, the combustion is carried out according to both said types of burner; thus, at the start, the combustion is done in atomized form of the liquid fuel, by spraying, by means of a cup or rotary bell, the fuel then being gasified by heating said bell or cup. Generally combustion by a blue flame results. Devices based on this principle have numerous drawbacks, due principally to the equilibrium and wear of the moving parts and their fouling.

It is another object of the invention to enable complete combustion of liquid fuel, whatever the power desired, very low (less than 1 liter per hour) or very high (several tens of liters per hour), without the presence of spraying members, such as a spray head or rotary cup. In addition, such combustion, in the form, for example, of a completely blue flame, according to the type of fuel used, avoids any atmospheric pollution.

Combustion of a liquid fuel, such as is produced in conventional systems, takes place according to a process in the course of which the conversion for liquid state to gaseous state, more or less well-mixed with combustion air, is carried out in the middle of the flame. In fact, a customary burner spray head does not permit intimate pre-mixing of air and gasified fuel, since the gasification is effected by explosion of micro-drops of atomized liquid fuel, which explosion is caused by the temperature which exists in the flame. Thus the flame is yellow and very animated.

It has also been conceived to draw liquid fuel by the combustion supporting air itself, so as to obtain at the same time, vaporization of said fuel and mixing of the latter with the combustion supporter. This method of procedure has drawbacks, due notably to the absence of pre-mixing the vaporized fuel and the combustion supporting air. The inventor has in fact observed, that to obtain good combustion, it was necessary to respect certain conditions and to establish a cycle in three phases.

GENERAL DESCRIPTION OF THE INVENTION

According to the invention, in a first phase, a gasification or vaporization of the liquid fuel, shielded from the flame, is carried out. Then, in a second phase, it is imperative to carry out mixing of the vaporized fuel with a combustion supporting agent such as air, in a special chamber and again shielded from the flame, so as to obtain stoichiometric mixing. Finally, in a third phase, combustion of the mixture thus-obtained is carried out, in a suitable zone, distinct from the vaporization and mixing zones.

According to a particularly advantageous feature of the invention the vaporization is carried out in a duct or channel heated by the combustion flame and into which the fuel is carried by a vector fluid, which may or may not be a combustion supporting agent, so as to permit skin vaporization of the liquid fuel and carbonization by pyrolysis of the non-vaporized substances in said duct or channel, which opens into the mixing chamber, wherein stoichiometric mixing of the vaporized fuel and of the combustion supporting agent is effected. This method enables notably reduction in the bulk of the vaporizing element, and permits long and lasting operation through self-cleaning.

The skin vaporization permits in fact, any contact between the wall of the vaporization element and the liquid to be vaporized to be avoided, which avoids any possible fouling of this element, whilst carbonization by pyrolysis, which consists of bringing certain parts of the burner to high temperature, enables the particularly dense and fatty, non-vaporizable elements to be removed. The skin vaporization is in fact a calefaction, maintained in a suitable device, if calefaction is considered as the physical process of vaporizing a liquid drop, by a wall at high temperature, this drop not being in contact with said wall because of the existence of a vapor film emitted from the drop itself, under the effect of the heat energy transmitted through the wall.

To apply this method, the inventor provides a burner for any liquid fuel, furnished with a hollow vaporizing body, with a means for initiating combustion and heating means for starting-up, characterized in that it comprises a fixed body, provided with a tubular vaporizing channel or duct, in which is carried, by a vector fluid which may or may not be combustion supporting, a liquid fuel, said channel or duct opening directly or not, into a mixing chamber, separate from said channel and which receives also a combustion supporter, the heating means being arranged to heat the fixed body on starting-up, whilst the shape of said body is such that the combustion flame partly licks the latter, so that the liquid fuel is vaporized or gasified shielded from the flame, at least partly, and preferably wholly, in the vaporizing channel or duct. The liquid fuel feeds the burner through an inlet pipe, opening into the vaporizing channel or duct, whilst the vector fluid, in the form, for example, of gas, air, steam or water, is introduced into said fuel vaporizing channel or duct, in the vicinity of said inlet pipe.

Such a device notably permits the production of pellicular vaporization and carbonization of the fatty elements, by pyrolysis, thus avoiding any risk of fouling.

In addition, the elimination of the spray nozzles for the atomization of the fuel as well as of moving parts, gives the above-mentioned fixed combustion head a very advantageous mechanical reliability, particularly in the case of its utilization in low-powered domestic equipment.

A burner according to the invention enables the equipment of boilers and generators, whose design is particularly adapted to use a high temperature blue flame.

Advantageously, the duct into which the fuel is carried, is constituted by a tubular coil buried, for example by over-molding, in the body of the burner. In addition, the mixing chamber is preferably constituted, at least in part by the body, so that the latter is heated permanently in the course of the combustion.

According to one embodiment, a reversing contact thermostat is provided to stop at the desired temperature, the starting-up heater means, in the form, for example, of a heating resistance and to cause, on the one hand, the introduction of liquid fuel and of the vector agent, into the vaporizing duct, and on the other hand, the actuation of the combustion initiating means, in the form, for example, of an electrode, controlled through a regulating box and a transformer.

The body may have a substantially annular shape, preferably flared outwardly, whilst a combustion grid or flame retainer is arranged in the central portion, so that the flame is centrally positioned and licks said body inwardly.

In this case, the mixing chamber is preferably constituted, at least partly, by the body, which has for this purpose in its central portion a cup shape, into which the combustion supporter enters through one or more openings arranged in the latter.

Advantageously, a final mixing chamber is arranged between the combustion grid or flame retainer and the mixing chamber, by means of a separator constituted by a plate, provided with a central duct which dips into the mixing chamber.

In the latter case, according to a preferred embodiment, the mixing chamber has a central inlet orifice for the combustion supporter, arranged in the lower wall of the latter and provided with a rim with converging walls directed towards the duct of the separator and substantially coaxially, said duct having a divergent shape or walls.

Another embodiment is characterized, in that the body has a substantially frustoconic shape, with a central starting-up heating means, whilst the combustion grid is arranged around said body, so that the annular flame licks said body outwardly.

In this case, advantageously, the mixing chamber is constructed in two parts, the first part arranged in the upper part of the body and into which the vaporizing duct opens and a second part arranged in the lower part of the body and in which the combustion supporter arrives, the two parts of the chamber communicating through orifices formed in the body, around the heating means, whilst a final annular mixing chamber is provided under the combustion grid and communicates with the above-mentioned second part of the chamber.

For these various embodiments, a casing is fixed under the mixing chamber and has an orifice, to allow the inlet pipe for the liquid fuel to pass, an orifice for the vector agent and an orifice for the combustion supporter thus constituting a pre-heating chamber.

Preferably, the vector agent or the combustion supporter are air, a single orifice in the casing then being provided for this air, which is directed partly into the vaporizing duct and partly into the mixing chamber.

It is however clear that the device according to the invention enables the use of another vector agent, as has already been stated, mixing with the combustion supporting air taking place in the chamber provided for this purpose.

The above-mentioned embodiments enable the selection, for the same flame power, of a short form of flame, covering a large surface or on the contrary, a very concentrated longer flame, according to the type of boiler or generator to be equipped.

The novel burners for liquid fuel according to the invention could also equip a new generation of heating equipment and exchangers for heat pumps, having a liquid fuel as supplementary energy source, instead of electricity. It is also possible to conceive small domestic heating equipment, operating by suction, thus avoiding the traditional chimney, assuming that the combustion gases can be directly discharged into the atmosphere.

It is obvious that the use of various materials and of different geometries for the hollow body can be conceived, without departing from the scope of the invention.

BRIEF DESCRIPTION OF THE DRAWINGS

The invention will be better understood and other features will become apparent, on reading the following description with reference to the accompanying drawing, in which.

DESCRIPTION OF PREFERRED EMBODIMENTS

Figure 1:
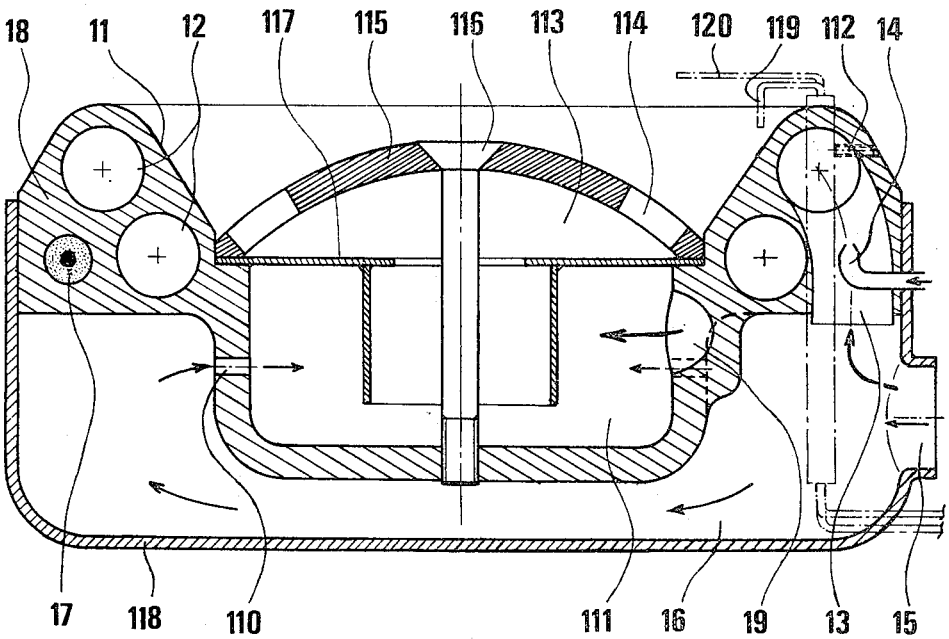
FIG. 1 is a sectional view of one embodiment of a burner according to the invention with a central flame.
Figure 3:
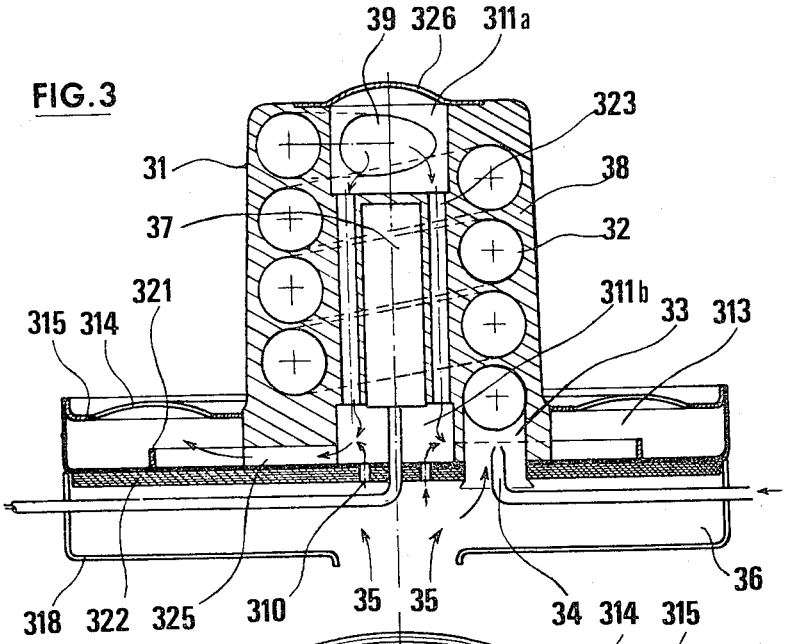
FIG. 3 is a sectional view, of another embodiment with an annular flame.
Figure 5:
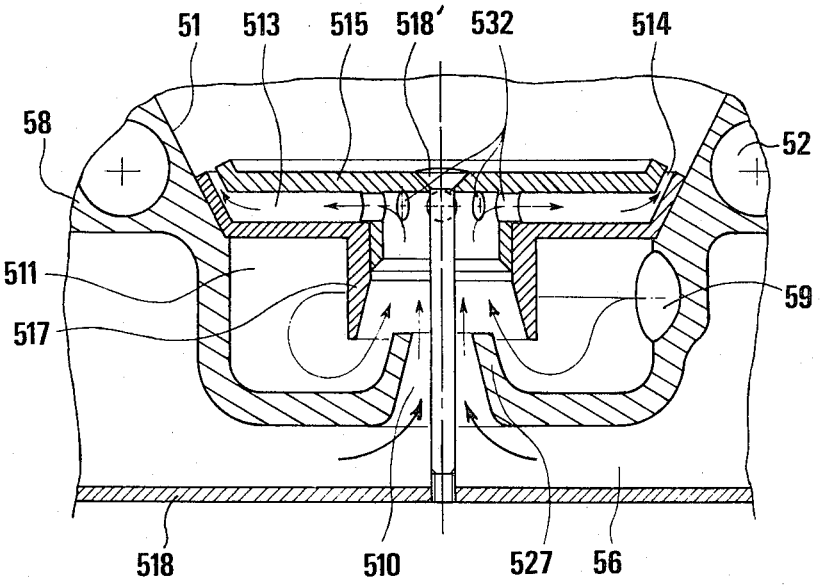
FIG. 5 is a partial view of the burner of FIG. 1, whose mixing chamber is modified.

The principal FIGS. 1, 3 and 5 show three embodiments according to the invention. In the numbering of each element, the first figure indicates the number of the main figure in which it is shown. To facilitate understanding, the one or more figures which follow the first figure of each reference numeral are identical when elements or members are denoted having the same or similar functions.

The burner according to the invention comprises a molded body 18, 38, 58 of metal, alloy or other material, resistant to high temperatures. This body is provided with a vaporizing duct 12, 32, 52 generally constituted by an over-molded tubular coil, whose inlet and outlet ends are denoted respectively by 13, 33 and 19, 39, 59. An electrical pre-heating resistance of annular shape 17, or in the shape of a central bar 37 is buried in the burner body. An inlet pipe 14, 34 for the liquid fuel, is arranged at the inlet of the vaporizing duct.

The duct 12, 32, 52 opens at 19, 39, 59, into a mixing chamber 111, 311, 511, constituted partly by the body, whilst another final mixing chamber 113, 313, 513, before combustion, is provided beneath a combustion grid or flame retainer 115, 315, 515.

A housing or casing 118, 318, 518, arranged below the mixing chamber, defines a pre-heating chamber 16, 36, 56 provided with an air inlet orifice 15, 35.

An ingniting or initiating electrode for combustion 119 and an electrode 120, for flame control by ionization (not shown in FIGS. 3 and 5) are fixed in the body 18 by means of locking screws, screwed into suitable orifices 112, whilst a thermostat (not shown), of the reversing contact type is arranged below said body, for example.

Figure 2:
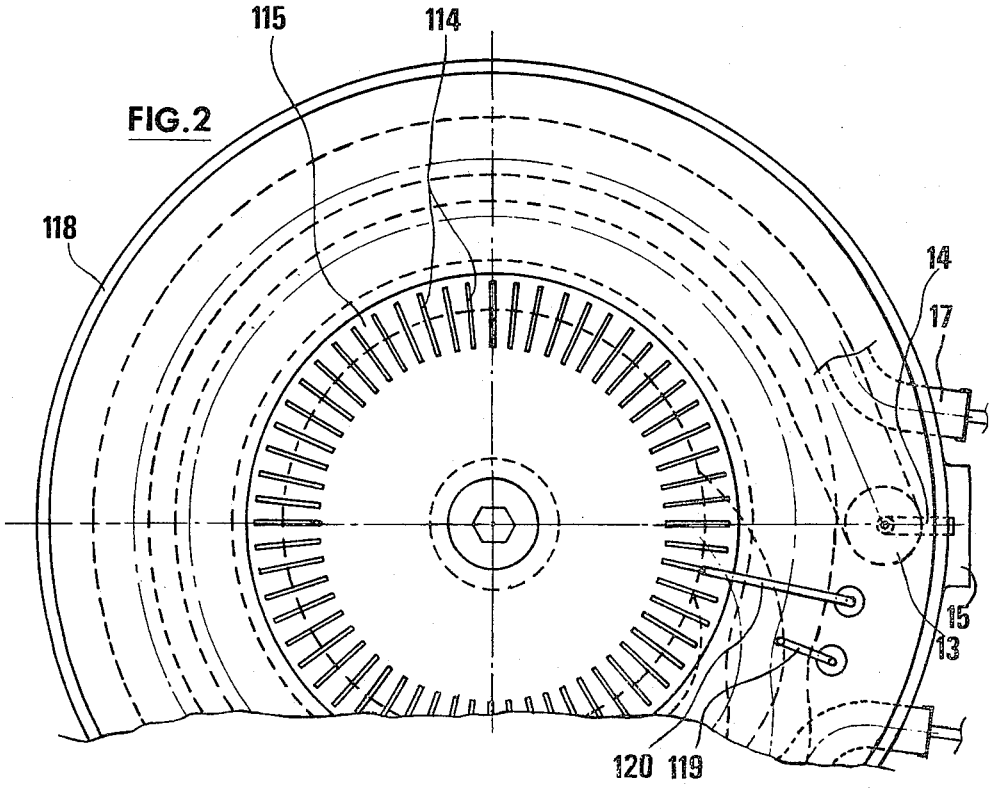
FIG. 2 is a partial overhead view, of the embodiment of the burner of FIG. 1.

FIGS. 1, 2 and 5 show embodiments in which the bodies 18, 58 have a substantially annular shape, outwardly flared, whilst the mixing chamber 111, 511 is constituted by said body, which has for this purpose, in its central portion, a cup shape. In these two embodiments, the final mixing chamber 113, 513 is bounded by a combustion grid or flame retainer 115, 515 and a separator 117, 517 provided with a duct in the form of a central well, which dips into said mixing chamber 111, 511. The combustion grid 115 is held by means of a screw 116, which passes through the duct of the separator 117 and which is screwed into the part of the body constituting the lower wall of the mixing chamber 111, whilst the grid 515 of FIG. 5 is fixed by a screw 518', screwed into the casing 518.

The mixing chamber 111 (FIG. 1) is provided with a plurality of peripheral orifices 110, which are preferably slightly inclined with respect to a radial position. On the contrary, in the embodiment of FIG. 5, the body 58, in the part constituting the mixing chamber 511 is provided with a central orifice 510, having a rim 527 with converging walls and arranged substantially coaxially with the duct of the separator 517, the latter having a divergent shape or walls.

The combustion grid 115 is provided with a plurality of slots 114, arranged radially, whilst the grid 515, arranged above the separator 517, forms an annular slot 514. The combustion grid 515 is provided with a central tubular element which nests in the duct of the separator 517 and which is provided with a plurality of orifices 532 for communication between the chambers 511 and 513.

The embodiment of FIG. 3 shows a substantially frustoconic body 38, provided with a central heating resistance 37, already mentioned, in the form of a bar or rod. In this embodiment, the mixing chamber includes two parts, 311*a* and 311*b*, arranged respectively above and below the resistors 37. The part 311*a* of the mixing chamber is hollowed directly in the upper part of the body 38 and closed by a cover 326, whilst the part 311*b* is hollowed in the lower part of said body and closed by a seal 322, of insulating material, arranged between the body 38 and the casing 318, so that the pre-heating chamber 36 is just below and the orifices 310 are arranged in said seal facing the air inlet orifice 35.

The part 311*a*, into which the vaporizing duct 32 opens at 39, communicates with the part 311*b*, receiving the combustion supporting air through the ducts 323.

The annular combustion grid 315, provided with slots 314, is arranged around the body 38. The part 311*b* of the mixing chamber communicates with the final mixing chamber 313 through channels with tangential outlets 325, whilst a ring 321 is arranged on the seal 322, in the final mixing chamber 313.

The embodiment having been described as regards their constitution, the operation will become clear.

The electrical resistance 17, 37 is first energized. When a sufficient temperature is reached (of the order of 250° to 280° C.) a thermostat (not shown) with a reversing contact, cuts off said resistance and simultaneously permits the introduction of liquid fuel through the inlet pipe 14, 34 and the introduction of air through the orifice 15, 35.

This thermostat, suitably arranged below the body 18, 38, 58, for example, causes at the same time and through a regulating box and a transformer, electrical arcs at the level of the initiating electrode 119.

In this way, the liquid fuel arrives at the inlet 13, 33 of the duct 12, 32, 52 through the inlet pipe 14, 34, at the same time that the air which comes from the chamber 16, 36, 56 fed through 15, 35.

The liquid fuel thus carried into the duct 12, 32, 52 is vaporized immediately and arrives at the mixing chamber 111, 311, 511.

In the latter, the vaporized fuel is intimately mixed with the combustion supporting air which arrives through the orifices 110, 310 and 510 after having been heated in the pre-heating chamber 16, 36, 56. The mixture is facilitated in the embodiment of FIG. 1, by the tangential inclination of the orifices 110, which causes a circular movement of the gases.

The combustion supporting air and the vaporized fuel are then led into the final mixing chamber 113, 313, 513. In the embodiments of FIGS. 1 and 5, the mixture produced passes through the central duct of the separator 117, 517. Advantageously, in the embodiment of FIG. 5, the converging walls of the rim of the orifice 510 and the diverging walls of the central duct of the separator 517, constitute a convergent divergent member which has the effect of substantially improving the flow of the fuel in the vaporizing duct.

In the embodiment of FIG. 3, the vaporized fuel arrives in the part 311*a* and is mixed with the combustion supporting air in the part 311*b* whilst the channels with tangential outlets enable turbulent mixing of the gases in the chamber 313, whilst the ring 321 results in good homogeneity of said gases.

The mixture obtained in the chamber 113, 313, 513 escapes through the grid 115, 315, 515 and is ignited immediately by means of the electrode 119, whilst the electrode 120 controls the flame by ionization and enables the supply of the igniting transformer to be stopped immediately, in the case of absence of flame. This flame control can also be achieved by means of an ionization cell, if desired.

The molded body 18, 38, 58 is thus heated by the flame resulting from the combustion of the fuel mixture which emerges through the slots 114, 314, 514, with sufficient speed to avoid combustion occuring beneath the grid 115, 315, 515. In this regard, it is interesting to note, that to obtain a speed of injection of the gases, higher than the speed of propagation of the flame, the communication cross-section of the separator 117, 517, constituted by a central duct, in the embodiments of FIGS. 1 and 5, must represent an area related to the total area of the slots 114, 514.

Figure 4:
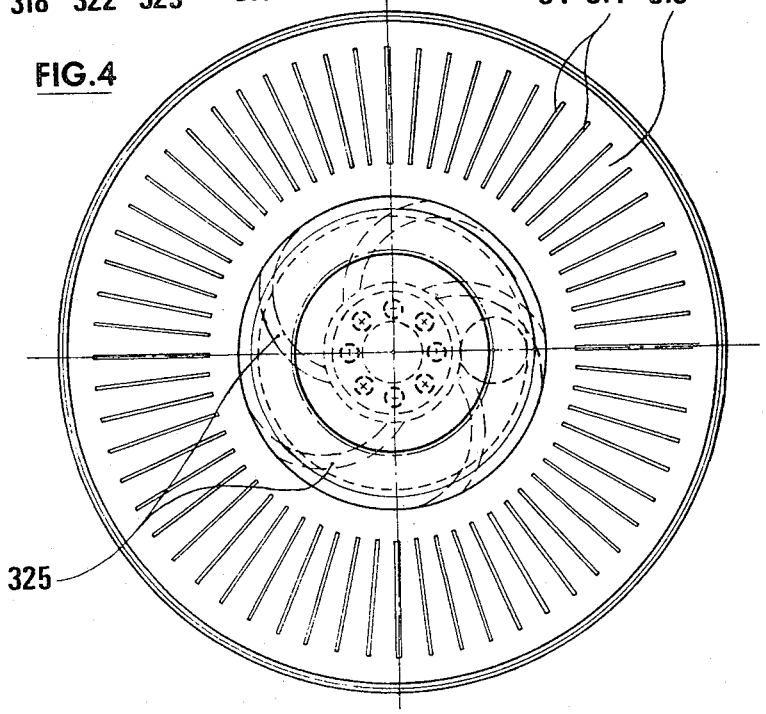
FIG. 4 is an overhead view, of the burner of FIG. 3.

The form of the molded body 18, 38, 58, which represents an area 11, 31, 51, in contact with the flame determines the form of said flame, and which can be inside (FIGS. 1, 2 and 5) or outside (FIGS. 3 and 4) of said body, that is to say have a central or annular position.

The body 18, 38, 58 enables thermic conduction between the resistance 17, 37 and the tubular coil constituting the vaporizing duct, and at the same time between the flame and said coil, which is brought to high temperature.

In the embodiments shown, the fuel which undergoes pellicular vaporization, is carried by air, which serves as a vector agent. However, it is possible to use another vector agent separate from the combustion supporting air, as it would if necessary be possible, to bring combustion air entirely through the inlet of the vaporizing duct.

However, the last mentioned case, which eliminates the need to arrange orifices 110, 310, 510 has certain drawbacks. It is, in fact, necessary then, to have a greater contact area 11, 31, 51 to heat a larger volume of air to the maximum temperature. It is also necessary to provide a vaporizing duct of larger cross-section (and hence a more cumbersome burner) to enable the same flow rate of air at the inlet 15, 35, or for the same duct cross-section, namely therefore for the same power, have a higher air pressure at said inlet. In addition, there would no longer in this case to be a combustion process with a separate mixing phase, as recommended by the invention.

The invention which has just been described enables the production of combustion whose advantages are numerous and more particularly:

(a) complete and anti-pollution combustion,
(b) a very high combustion yield (energy economy),
(c) simplicity of construction (low cost price),
(d) completely silent operation,
(e) small volume with respect to the power desired,
(f) self-cleaning by pyrolysis,
(g) design enabling mass production,
(h) the design of novel boilers and heat exchangers,
(i) smaller volume of combustion gases for the same power and hence reduction in volume of the hearths of heating equipment,
(j) completely blue flame combustion and hence no risk of unburnt products,
(k) production of 15.2% of $CO_2$ for the combustion of domestic fuel oil (that is to say the maximum possible),
(l) no moving part and hence no mechanical wear,
(m) the possibility of having very low flow rates (less than 1 liter/h) without the risk of obstruction, due to the absence of a spray nozzle,
(n) low power, the possibility of evacuating directly to the outside and without a chimney, of the combustion gases (suction system),
(o) economy in construction and utilization costs, due to the absence of the duct of the heater chimney, Numerous modifications or variations can be conceived, without departing from the scope of the invention. Thus for example, the vaporizing duct may not be provided with an over-molded coil, the vector can be something other than air, the casing 118, 318, 518 can be omitted, etc. In addition, the shapes of the body and of the combustion grids may be different, as well as the shape of the slots of said grids, constituted for example, by circular orifices or the like.

The principal purpose of the invention is to provide a good method of combustion and a burner as described above, in which the vaporizing duct or channel is arranged in the fixed body so as to be sufficiently heated by the flame, but shielded from the latter, so as to permit pellicular vaporization of the liquid fuel carried by the vector fluid through said channel or duct, whilst the mixing chamber enables the production of a mixture in stoichiometric proportions, shielded from the flame, of the previously vaporized fuel and of the combustion supporter.

I claim:

1. A fuel burner comprising:
(a) a vaporizing body;
(b) a vaporizing duct coiled within said vaporizing body;
(c) combustion initiating means;
(d) heating means for heating said burner body during start-up, said heating means comprising an electric resistance heater;
(e) a mixing chamber in fluid communication with said vaporizing duct;
(f) means for introducing a fuel into said vaporizing duct;
(g) means for introducing a vector fluid into said vaporizing duct for transporting said fuel;
(h) a combustion grid on which said fuel is burned in a flame; and wherein said vaporizing duct and vaporizing body are positioned and configured whereby said flame at least partially licks said vaporizing body to heat said fuel passing through said vaporizing duct and wherein said resistance heater is positioned to heat said fuel and said vector fluid in said mixing chamber prior to passage through said combustion grid.

2. The burner as defined by claim 1 wherein said vaporizing body is molded and at least partially includes said mixing chamber therein.

3. The burner as defined by claim 2 wherein said vaporizing duct comprises a tubular coil imbedded in said vaporizing body.

4. The burner as defined by claim 1 wherein said means for introducing said fuel into said vaporizing duct comprises an inlet line and said means for introducing said vector fluid into said vaporizing duct is adapted to introduce said vector fluid around said inlet pipe.

5. The burner as defined by claim 4, wherein said means for introducing said vector fluid is connected to a source of gas, air, or water.

6. The burner as defined by claim 1 further comprising means for introducing a combustion supporter into contact with said fuel and wherein said vaporizing body comprises said vaporizing duct therein and has a substantially frustoconic shape, and said combustion grid is arranged around said vaporizing body so as to form said annular flame adapted to lick the outer portion of said vaporizing body.

7. The burner as defined by claim 6 wherein said vaporizing body comprises a centrally positioned hollow portion and wherein said vaporizing duct is a tubular coil positioned within said vaporizing body around said hollow portion, said vaporizing duct being in fluid communication with said hollow portion for feeding said fluid and fuel therein, and an annular chamber positioned beneath said combustion grid and beneath said hollow portion, said annular chamber being adapted for the final mixing of said fuel and said combustion supporter.

8. The burner as defined by claim 1 further comprising a preheating chamber, itself comprising a casing positioned under said mixing chamber, said chamber having an orifice for the introduction of said combustion supporter, an orifice for the introduction of said vector fluid, and an orifice allowing for the passage of said means for introducing fuel into said vaporizing duct.

9. The burner as defined by claim 8 wherein said means for introducing said vector fluid and said means for introducing said combustion supporter are both in fluid communication with a common source of air, through a common single orifice in said casing, said orifice being positioned to direct portions of said combustion supporting agent and said vector fluid into said vaporizing duct and into said mixing chamber.

10. The burner as defined by claim 1 wherein said means for introducing fuel into said vaporizing duct is connected in fluid communication with a liquid fuel source.

11. The burner as defined by claim 1 wherein said vaporizing body has a substantially annular shape and wherein said combustion grid is centrally positioned on said body whereby said flame is centrally positioned so as to at least partially lick said vaporizing body.

12. The burner as defined by calim 1 wherein said mixing chamber is at least partly positioned within said vaporizing body and is constituted by a cup-shaped chamber centrally positioned in said vaporizing body.

13. The burner as defined by claim 12 further comprising a final mixing chamber arranged between said combustion grid and said mixing chamber, said final mixing chamber being defined between said combustion grid and a separator comprising a plate provided with a central duct in fluid communication with said mixing chamber.

* * * * *